US005927450A

United States Patent [19]

Sadow

[11] Patent Number: 5,927,450

[45] Date of Patent: Jul. 27, 1999

[54] AUXILIARY LUGGAGE HOLDER WITH EXTERNAL POCKET FOR AUXILIARY SECUREMENT STRAP

[75] Inventor: Bernard David Sadow, Chappaqua, N.Y.

[73] Assignee: Outrigger, Inc., Chappaqua, N.Y.

[21] Appl. No.: 09/055,128

[22] Filed: Apr. 3, 1998

Related U.S. Application Data

[63] Continuation of application No. 08/694,209, Aug. 8, 1996, which is a continuation-in-part of application No. 08/491,619, Jun. 19, 1995, abandoned, which is a continuation-in-part of application No. 08/488,611, Jun. 8, 1995, abandoned.

[51] Int. Cl.[6] ..... A45C 5/14; A45C 13/30; A45C 13/38

[52] U.S. Cl. ..... 190/102; 190/18 A; 190/108

[58] Field of Search ..... 190/102, 108, 190/18 A, 39, 115

[56] References Cited

U.S. PATENT DOCUMENTS

| | | | |
|---|---|---|---|
| 359,219 | 3/1887 | Lyon | 190/101 |
| 504,850 | 9/1893 | Ponickau | 190/102 |
| 672,173 | 4/1901 | Le Fevre | 190/102 |
| 746,617 | 12/1903 | Wenzell | 190/102 |
| 798,531 | 8/1905 | Riecke | 190/102 |
| 948,170 | 2/1910 | Grossman | 190/102 |
| 1,727,954 | 9/1929 | Beehler | 190/102 X |
| 2,372,845 | 4/1945 | Nelson | 190/108 |
| 4,420,068 | 12/1983 | Gerch | 190/102 |
| 4,424,841 | 1/1984 | Smith | 190/102 X |
| 4,431,041 | 2/1984 | Leiserson | 190/102 X |
| 4,506,769 | 3/1985 | Franco et al. | 190/108 |
| 4,508,202 | 4/1985 | Siegert et al. | 190/115 |
| 4,538,709 | 9/1985 | Williams et al. | 190/18 A |
| 4,693,345 | 9/1987 | Mittelmann | 190/108 |
| 4,738,341 | 4/1988 | Asano | 190/101 |
| 4,759,431 | 7/1988 | King et al. | 190/18 A |
| 5,099,968 | 3/1992 | Kikuchi | 190/108 |
| 5,230,450 | 7/1993 | Mahvi et al. | 190/108 X |
| 5,240,106 | 8/1993 | Plath | 206/316.2 |
| 5,291,976 | 3/1994 | Ku | 190/18 A |
| 5,353,900 | 10/1994 | Stilley | 190/18 A |
| 5,355,980 | 10/1994 | Hsieh | 190/115 |
| 5,431,262 | 7/1995 | Rekuc et al. | 190/102 X |
| 5,560,458 | 10/1996 | Franklin et al. | 190/102 X |
| 5,566,797 | 10/1996 | Van Himbeeck | 190/102 X |
| 5,575,362 | 11/1996 | Franklin et al. | 190/102 X |
| 5,593,009 | 1/1997 | King | 190/102 |
| 5,699,886 | 12/1997 | Latshaw | 190/108 |
| 5,762,169 | 6/1998 | Deliman et al. | 190/102 X |

FOREIGN PATENT DOCUMENTS

| | | |
|---|---|---|
| 187318 | 7/1986 | European Pat. Off. . |
| 2358124 | 3/1978 | France . |
| 586828 | 10/1933 | Germany . |
| 577808 | 7/1976 | Switzerland . |
| 327545 | 4/1930 | United Kingdom . |
| 396926 | 8/1933 | United Kingdom . |
| 399017 | 9/1933 | United Kingdom . |

*Primary Examiner*—Sue A. Weaver
*Attorney, Agent, or Firm*—Abelman, Frayne & Schwab

[57] ABSTRACT

A wheeled article of luggage, such as a carry-on case, is provided with an elongate member which is extensible for it to secure an article of auxiliary luggage positioned on a top wall of the wheeled case. The extensible member can be built into the carry-on case, and conveniently stored in an externally accessible pocket.

13 Claims, 9 Drawing Sheets

FIG. 17
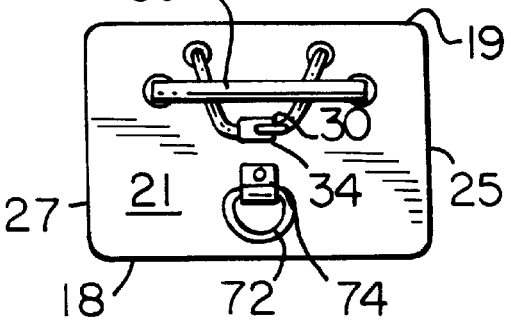
FIG. 16
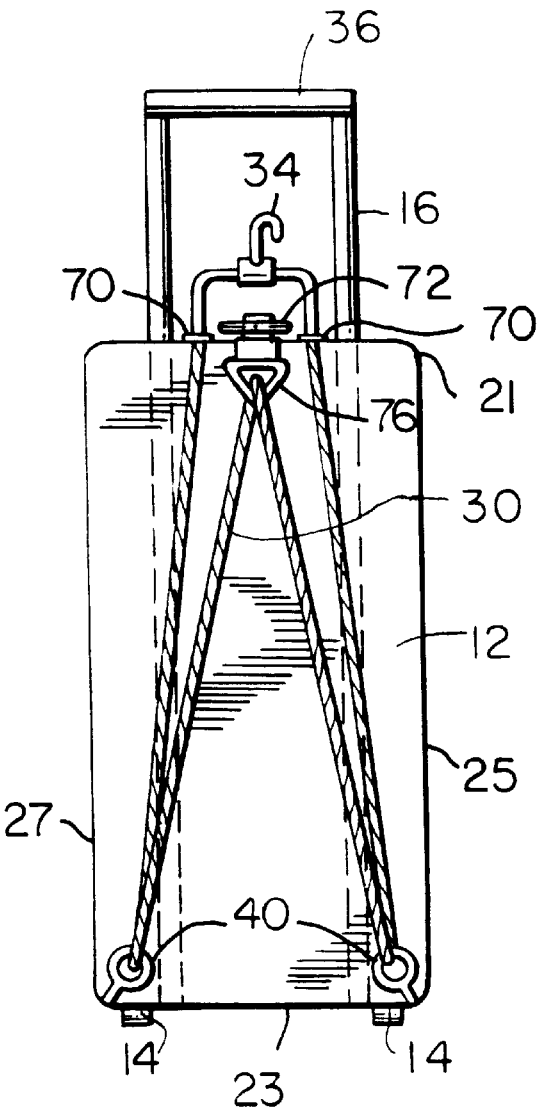
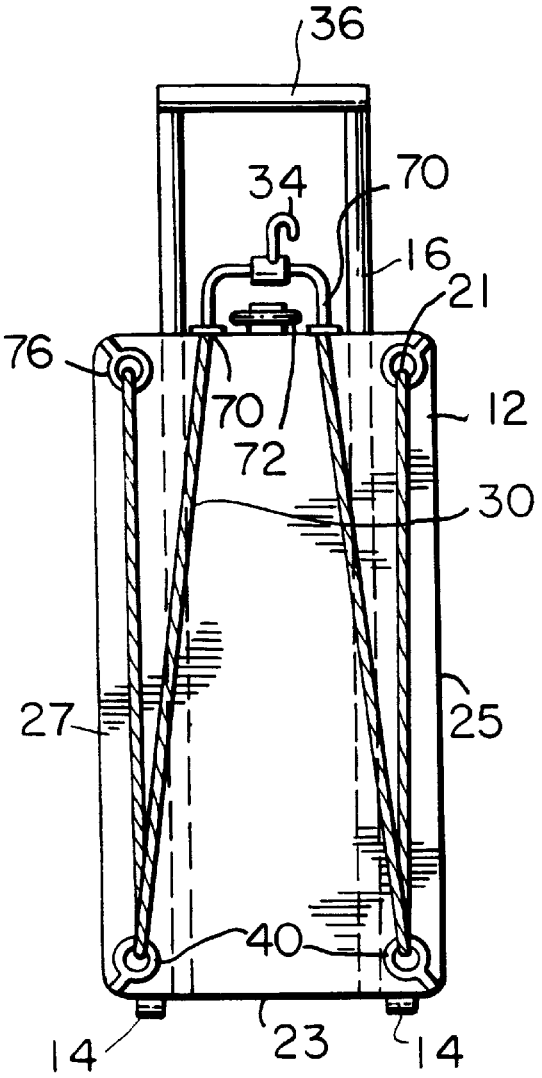
FIG. 18

AUXILIARY LUGGAGE HOLDER WITH EXTERNAL POCKET FOR AUXILIARY SECUREMENT STRAP

This application is a continuation of U.S. application Ser. No. 08/694,209, filed Aug. 8, 1996, which is a Continuation-In-Part of U.S. application Ser. No. 08/491,619, filed Jun. 19, 1995, now abandoned which in turn is a Continuation-In-Part of U.S. application Ser. No. 08/488,611, filed Jun. 8, 1995, now abandoned all entitled AUXILIARY LUGGAGE HOLDER.

FIELD OF THE INVENTION

This invention relates to an auxiliary luggage holder that forms part of an article of wheeled luggage, such as a carry-on case.

BACKGROUND OF THE INVENTION

Wheeled articles of luggage are well known in the art. Those cases include a substantially rectilinear storage case that is provided with wheels along one lower side, and, which is provided with a retractable handle that can be extended for towing the case, or, retracted for storage within the case.

Commonly, the person using such a case, which may be a wheeled carry-on case, will also be carrying a briefcase or tote bag, or similar article of personal luggage.

Commonly, the wheeled luggage is provided with a strap, that is secured to the wheeled case at a location adjacent to the top front edge of the case, i.e., at a position remote from the towing handle. That strap can be attached directly to the article of auxiliary luggage, or can be passed through the handle of the article of auxiliary luggage, and then be secured to an eyelet on the wheeled carry-on case, the article of auxiliary luggage then being loosely positioned frontally of the wheeled case.

However, when so positioned, the center of gravity of the auxiliary article of luggage is positioned forwardly of the wheeled case, and, if the article of auxiliary luggage is sufficiently heavy, can cause the wheeled case to fall forwardly if the wheeled case is left unattended in a standing position.

OBJECT OF THE INVENTION

It is an object of this invention to provide for the securement of an auxiliary article to a wheeled case with the center of gravity of the auxiliary article positioned over the center of gravity of the wheeled case. This reduces the possibility of forwards falling-over of the wheeled case if left unattended, and, additionally, to secure the auxiliary article to the main body of the wheeled case in such a manner as to facilitate towing of the article of wheeled luggage, it here being commented that if the auxiliary article is positioned forwardly of the main body of the wheeled case, it may have a tendency to swing laterally during the towing operation, especially in the event that the towing operation is proceeding in a jerky manner, or, the wheeled case is encountering turns in direction. The auxiliary article, which may be an item of personal luggage, package or other container, will henceforth be referred to as an "article of auxiliary luggage."

The article of auxiliary luggage, according to the present invention, is advantageously secured against the top surface of the wheeled case.

According to the present invention, a wheeled article of luggage, such as a carry-on case, is provided with an elongate resiliently extensible securement strap.

The securement strap can be comprised of a resiliently extensible material, such as a fabric encased rubber cord.

Exteriorly of the wheeled case, the securement strap is provided with an attachment member, such as a hook member, whereby that end of the securement strap that is located exteriorly of the wheeled case can be attached to a support member, which can be the handle of the wheeled case, or, an eyelet or open ring attached to the wheeled case.

The resilient member will be biased towards its retracted condition and can be of any known type, including coil springs, elastic cord or elastic ribbon material, or, any other form of resiliently elongatable members, such as one or more accordion springs.

The securement strap is suitably attached to the wheeled case and stored within an externally accessible pocket of the wheeled case. Alternatively, the securement strap, and the resiliently extensible member, if provided, can be located (i) within a sleeve of fabric or other suitable material extending vertically externally of the back wall of the wheeled case, (ii) within a channel member that has been attached externally to the rear wall of the wheeled case, or (iii) along the internal side of either the front or rear wall of the wheeled case.

A multitude of possible configurations of the resiliently extensible securement strap will suggest themselves to persons skilled in the art, in order to provide a securement strap that normally is held retracted, preferably within the externally accessible pocket, and, which at the option of the user, can be extended from the wheeled carry-on case, for it to be entrained around the article of auxiliary luggage when positioned on and against the surface of the top wall of the wheeled case, and then be secured to a member associated with the wheeled case.

The securement strap then provides a resilient bias acting to maintain the article of auxiliary luggage positioned on the top wall of the wheeled case, with the center of gravity of the respective article of auxiliary luggage arranged substantially in vertical alignment with the center of gravity of the main case when the wheeled case is positioned in an upright position on the floor.

The resiliently extensible securement strap can extend internally within the wheeled case, connected to anchor type retainers, and accessible through an exterior pocket of the wheeled case. Alternatively, it can be confined therein within a sleeve of fabric material, or within a channel-shaped member, or, it can be positioned within tubular poles that may be manually moved outward from within the case, the poles providing a support for the handle of the wheeled case, or, it can be contained entirely within the handle of the wheeled case.

The securement strap can be in the form of an elastically biased cord which is successively routed through a series of spaced retaining elements along the top and bottom of the rear or front wall to increase the extendible length of the securement strap.

DESCRIPTION OF THE DRAWINGS

The invention will now be described with reference to the accompanying drawings, in which:

FIGS. 5–18 are diagrammatic illustrations illustrating alternative arrangements of the securement strap;

FIG. 5 shows the restraining member in the form of an extensible member connected internally of the case and passed through top openings of the case.

FIG. 6 shows the extensible member in the form of extensible webbing, attached to the bottom of the case and extending through the top wall of the case.

FIG. 7 is similar to FIG. 5, but shows additional routing of the extensible member within the case to increase its length.

FIGS. 8–10 show the extensible member secured respectively to a coil spring, accordion spring, or spring loaded spools to provide a biasing force.

FIG. 11 illustrates an alternative embodiment, in which the restraining member is contained within poles providing the support for the handle;

FIG. 12 is a view similar to FIG. 11 showing an alternative embodiment in which the restraining member includes coiled springs;

FIG. 13 illustrates still another embodiment, in which the extensible restraining member is contained within and extensible from the handle itself of the wheeled carry-on case;

FIG. 14 illustrates an alternative embodiment of FIG. 13 in which the extensible restraining member is within an auxiliary cross-bar to be attached to the handle assembly; and, FIG. 15 is a plan view of an auxiliary cross-bar of FIG. 14;

FIGS. 16 and 17 are diagrammatic front and top views of an embodiment similar to FIG. 7, but with an alternative securement between the extensible member and case;

FIG. 18 is an embodiment similar to FIG. 16, but with a modified routing of the extensible member within the case.

DESCRIPTION OF THE PRIOR ART

Figure 1:
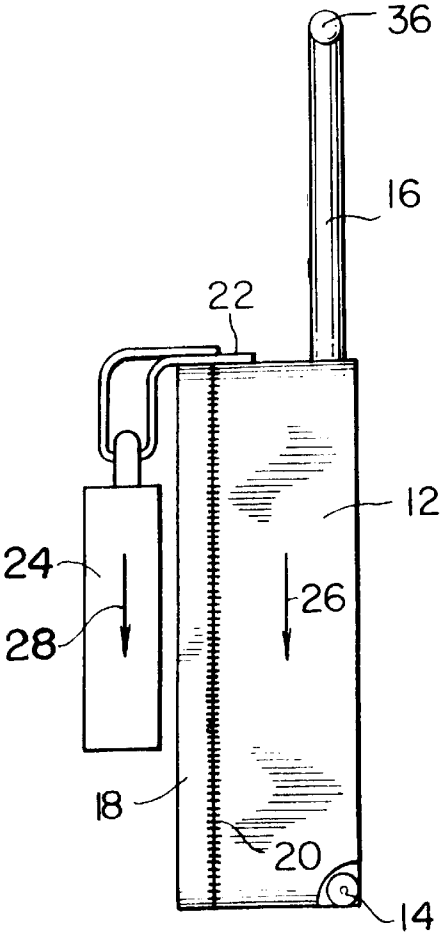
FIG. 1 PRIOR ART
FIG. 1 is a diagrammatic illustration of a prior art wheeled carry-on case.

Referring now to FIG. 1 of the drawings, the wheeled article of luggage which may be a carry-on case is comprised by a main case body 12 having front wall 18, back wall 19, top wall 21, bottom wall 23 and side walls 25, 27. Front wall 18 and back wall 19 define first opposed walls, side walls 25–27 define second opposed walls, and top wall 21 and bottom wall 23 define third opposed walls. Each of walls 18, 19, 25, and 27 have major and minor dimensions with the major dimensions being substantially equal, and separating the top and bottom walls 21, 23. Lower wheels 14 are secured to bottom wall 23 and a retractable handle 16 can extend upward of top wall 21. The case is adapted to be placed on a surface, with the wheels 14 contacting the surface, and the top wall 21 spaced from the wheels 14 by the major dimension, which is substantially greater than the lengths of the perimeter portions forming the front and top walls. Thus, when the case is wheeled, its major dimension will be oriented in a generally vertical direction. Handle 16 either can be retracted into the main case 12, or can be extended therefrom in order to permit towing of the case by angling the case into ground engagement of the wheels 14.

The main body of the case 12 is provided with an openable front side 18 that is secured to the main body of the case by a zip fastener 20, the top surface 21 of the case body having secured thereto a strap 22.

The strap 22 is provided with any convenient means such as a Velcro (registered trademark) hook and eye fastener, the strap 22 being provided for the support of an auxiliary article of luggage 24, which can be hung from the front face 18 of the case 12 by passing the strap 22 through the handle of the auxiliary article of luggage 24, which commonly is a briefcase, the strap 22 then being attached at its free end to the main body of the strap 22.

In this configuration, the auxiliary article of luggage 24 is hung forwardly of the main body of the case 12. Thus, the center of gravity 26 of the case 12 and the center of gravity 28 of the auxiliary article of luggage 24 are arranged in side-by-side relationship instead of end-to-end relationship. If the weight of the auxiliary article of luggage 24 is sufficient, then, the downwards pull at the front of the main case 12 can cause tipping forwardly (to the left in FIG. 1) of the entire assemblage if the handle 16 is released by the user.

Also, as the article of luggage 24 is hung from the body of the main case 12 in the manner of a pendulum, jerking forwards motion by the user when towing the article of wheeled luggage can cause the auxiliary article of luggage 24 to bounce randomly. Also, the turning of corners while towing the wheeled carry-on case can cause the auxiliary article of luggage 24 to swing in the manner of a pendulum, this providing unbalance to the wheeled carry-on case, and also, discomfort to the person towing the wheeled carry-on case.

DESCRIPTION OF THE PREFERRED EMBODIMENTS

Referring now to FIGS. 2 through 20, which illustrate preferred embodiments of the invention, like reference numerals have been employed to those members in common with FIG. 1.

FIGS. 2, 3, 3A and 4 each are side views of the wheeled carry-on case shown in FIG. 1, when modified in accordance with the present invention.

As will be immediately apparent, the wheeled carry-on case of FIGS. 2, 3, 3A and 4 each exclude the carrying strap 22 for the auxiliary article of luggage 24 as shown in prior art FIG. 1.

Figure 4:
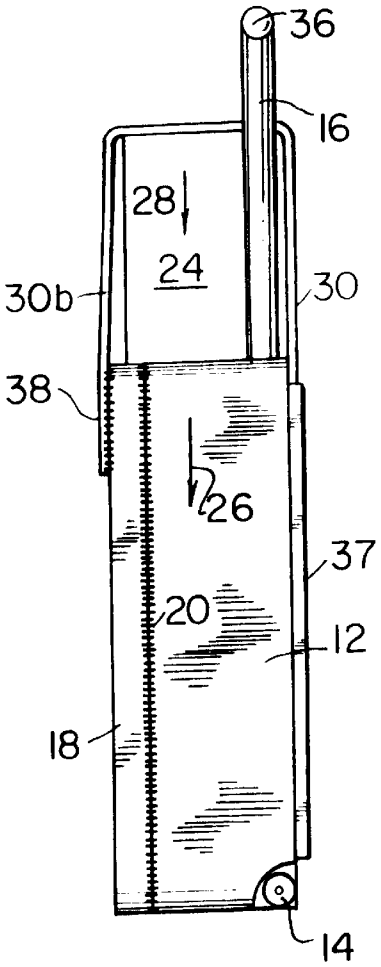
FIG. 4 is a view corresponding with FIG. 3, but illustrating a modification in the form of the restraining member and its connection to the case.
Figure 3:
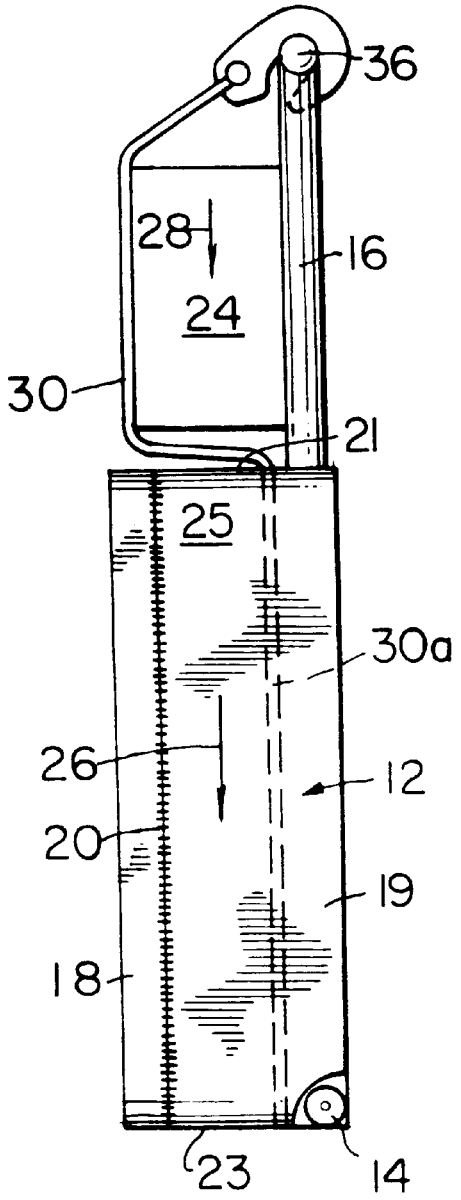
FIG. 3 is a diagrammatic illustration corresponding with FIG. 2, and showing the extensible restraining member when it is in its extended position in which it retains an article of auxiliary luggage, at the top wall of the case.
Figure 3A:
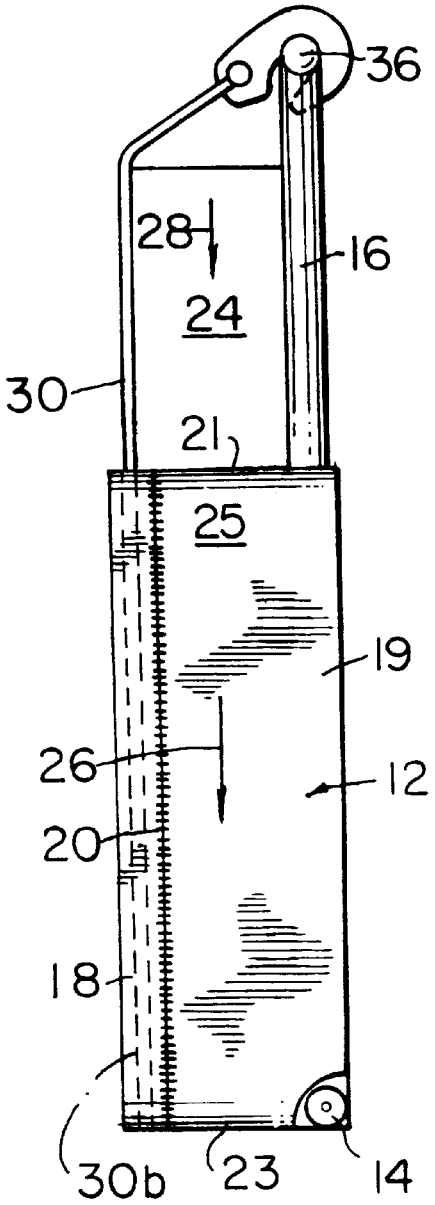
FIG. 3A indicates diagrammatically a modified placement of the extensible restraining member in the openable lid of the carrying case.

Instead, and as is shown more particularly in FIGS. 3, 3A and 4, the auxiliary article of luggage 24 is supported vertically above the main case 12 of the wheeled carry-on case against the surface of top wall 21, such that the center of gravity 28 of the auxiliary article of luggage is positioned vertically above the center of gravity 26 of the main case 12 of the wheeled carry-on luggage. When in the position shown in FIGS. 3, 3A and 4, the auxiliary article of luggage 24 is incapable of tipping the main case 12 forwardly, as has previously been discussed with reference to prior art FIG. 1.

Figure 2:
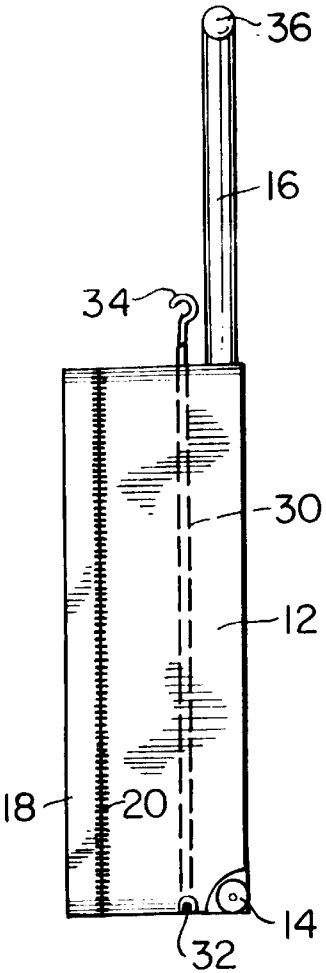
FIG. 2 is a diagrammatic illustration of a wheeled carry-on case according to one embodiment of the present invention, showing a restraining member for an article of auxiliary luggage, when the extensible restraining member is in its retracted condition.

Referring more particularly to FIG. 2, an extensible member 30 extends into the body of the case 12, and is secured to the bottom wall 23 of the case at 32.

The extensible member can be an extensible cord, such as a rubber cord, or, it can be an extensible webbing in which the longitudinal cords are comprised of rubber strands, or, as later described, it can be of non-extensible cord or webbing, which is attached at one of its ends to the bottom wall of the case 12 by an extensible spring.

While the extensible member 30 is illustrated in FIGS. 2 and 3 as extending into the body of the case 12, as illustrated by FIG. 4, equally well, the extensible member 30 can be contained in a channel member 37 attached to the rear wall 19 of the case 12, or, as indicated at 30*b*, of FIG. 3A can be contained within the lid 18 provided by the openable side, or, can be positioned for it to extend internally or externally of the side walls of the case.

Figure 5:
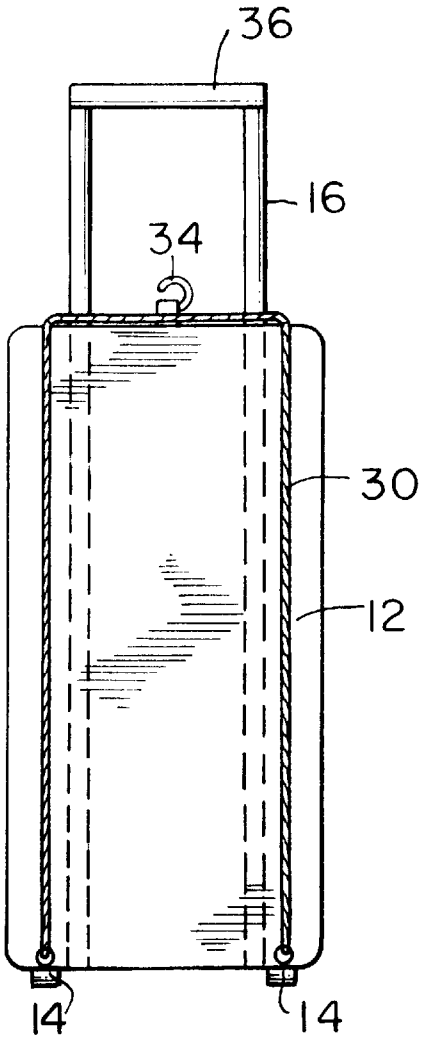

Referring now to FIGS. 2 and 5, to locate the auxiliary article of luggage 24 vertically above the case 12, all that is necessary is for the user to grasp the hook 34 attached to the extensible member 30, to pull the hook 34 upwardly, thus causing extension of the extensible member 30, then, as illustrated in FIG. 3, to pass the extensible member 30 forwardly of the auxiliary article of luggage 24, and then, to hook the hook 34 onto the cross-bar 36 of the handle 16.

As is illustrated diagrammatically in FIG. 5, the extensible member 30 is comprised of a single length of extensible cord, which is passed through openings in the top wall of the case 12, and then is attached at its ends to the bottom wall of the case.

Figure 6:
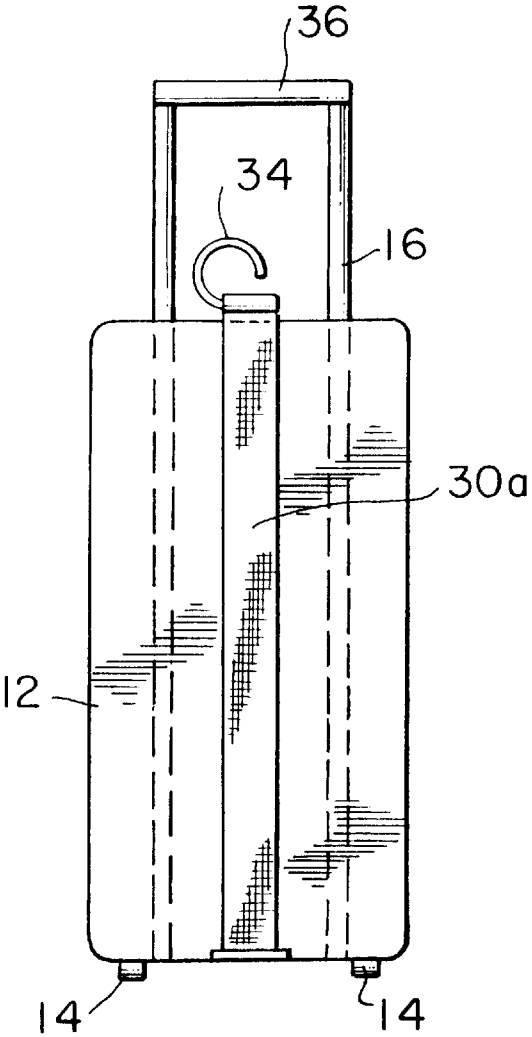

Alternatively, and as illustrated in FIGS. 3 and 6, the extensible member 30 can be a length of extensible webbing 30A, which similarly is attached at its lower end to the bottom wall of the case, and which, at its upper end, extends through the upper wall of the case, and which is provided with a hook member 34, by means of which the extensible webbing 30A can be hooked onto the cross-bar 36.

Referring now to FIGS. 4 and 6, instead of the extensible member 30 being confined within the case 12, it can be confined within a channel member 37 attached to the rear face of the case 12, in which case, the extensible member 30 can be a length of extensible webbing 30*b*, which, at its free end is provided with a hook and eye Velcro (registered trademark) fastener 38, by means of which it can be attached at its end directly to the front wall 18 of the case 12, in which event, the hook 34 of FIGS. 2 and 3 is rendered unnecessary.

Figure 7:
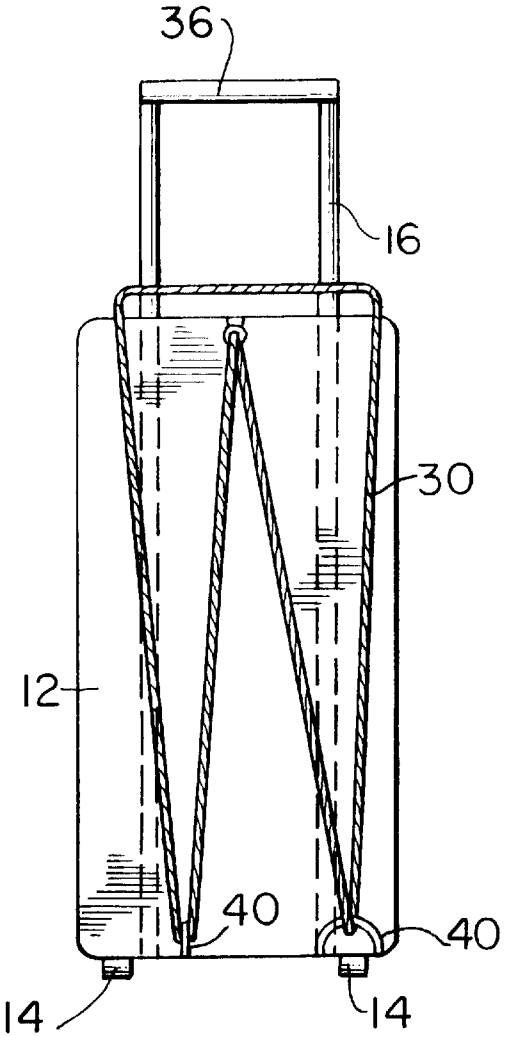
Figure 12:
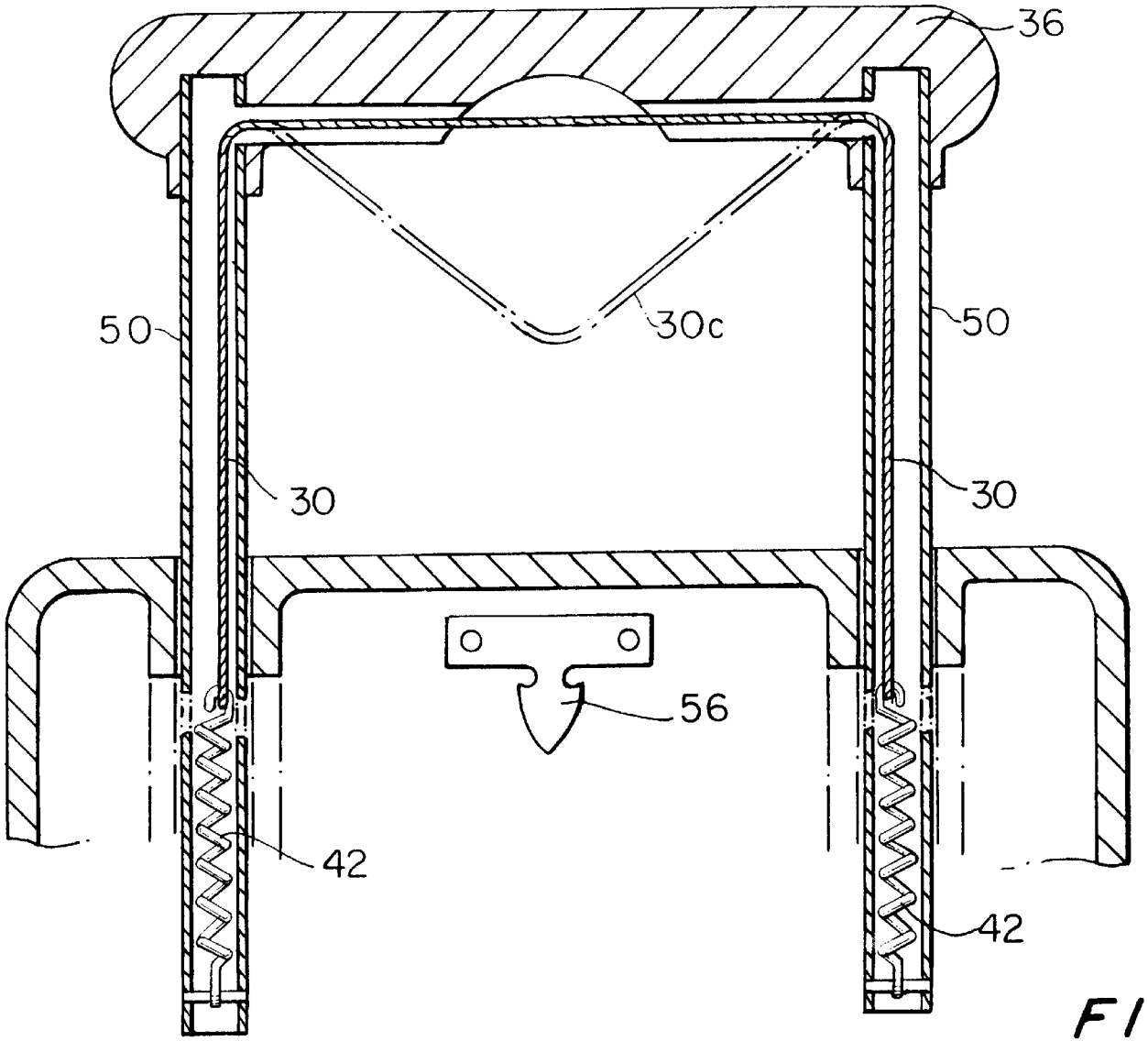

Referring now to FIG. 7, which illustrates an embodiment similar to the one discussed with respect to FIG. 5, instead of being secured at its ends directly to the bottom wall of the case 12, the extensible member 30 can be passed through eyelets 40 attached to the bottom wall 23 of the case 12, thus to provide a greater available length of extensible member. The portion of extendible member 30A which extends through openings 70 in the top wall 21 of the case is then manually grasped and placed about the auxiliary article of luggage (not shown, but generally corresponding to 24 of FIGS. 3 and 4) placed against the surface of the top wall 21 of the case. The extensible member portion 30A is then placed in its extended portion by engaging an appropriate connecting member on the case. It can be placed directly over the crossbar of handle 36, or the tongue of a member 56 as shown in FIG. 12. Alternatively, a hook (such as 34 of FIG. 6) may be connected to the portion 30A of the extensible member, for connection to the cross-bar 36. Similarly, and as related to FIG. 6, the extensible member portion 30A can be passed through an eyelet secured to the bottom wall of the case 12, and then be doubled back on itself and attached at its end to the upper wall of the case 12, this, again, providing for a greater permissible extended length of the extensible member 30.

Figure 8:
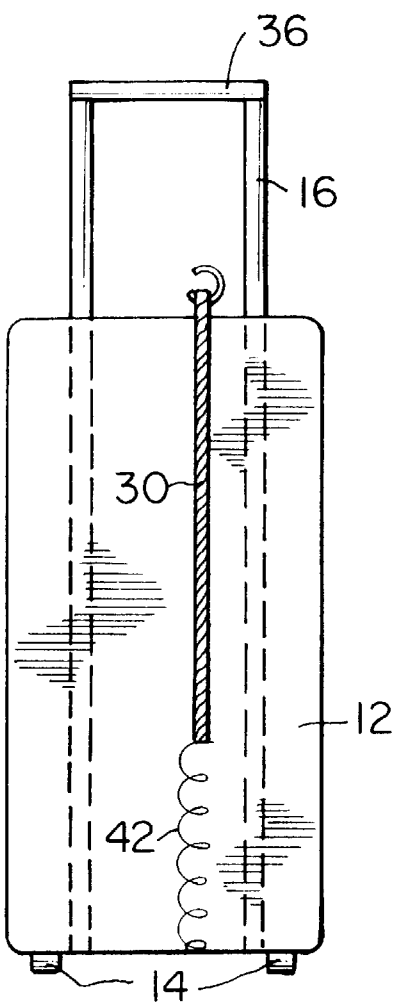

Referring now to FIG. 8, the extensible member 30 is secured to one end of a coil spring 42, the other end of the coil spring being secured to the bottom wall of the case 12. The free end of the extensible member 30, which extends out of the top wall of the case includes a hook 34. In a similar manner as shown in FIG. 3, after an auxiliary article of luggage is placed on the top wall 21 of the case, the hook 34 may be connected to the cross-bar 36.

Figure 10:
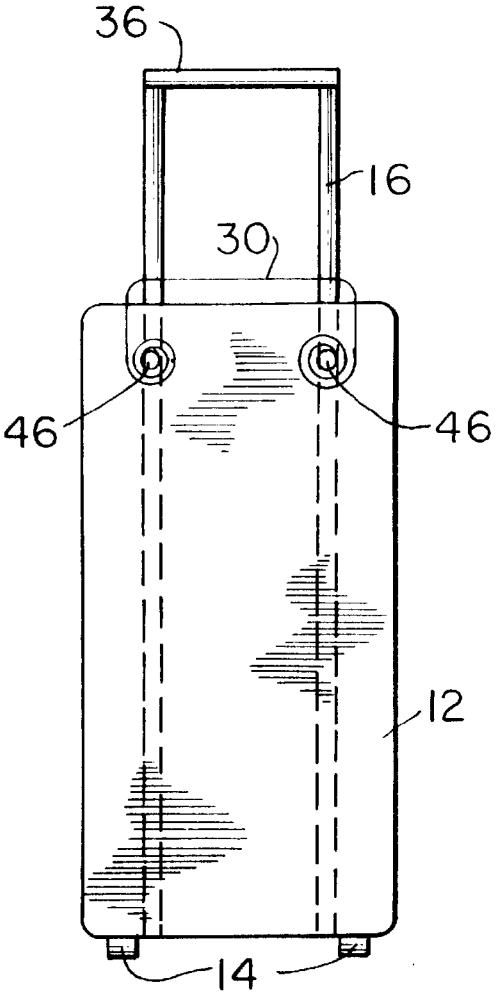
Figure 9:
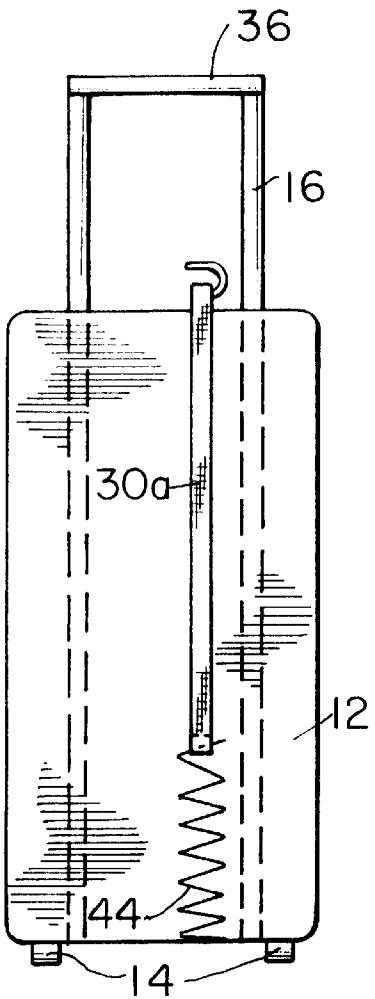

Alternatively, and as illustrated in FIG. 10, the extensible member 30 can be wound onto spring-loaded spools 46 in the manner of a conventional measuring tape with its ends 46-1 connected to the springs. The central portion 30A of the extensible member 30, may include a hook (not shown) for connection to the cross-bar 36 after the auxiliary article of luggage is placed on the top wall 21 of the case, and the member 30 encircles same. Alternatively, as discussed with respect to FIG. 7, central portion 30A may engage the tongue of a connecting member (such as 56 shown in FIG. 12).

Figure 11:
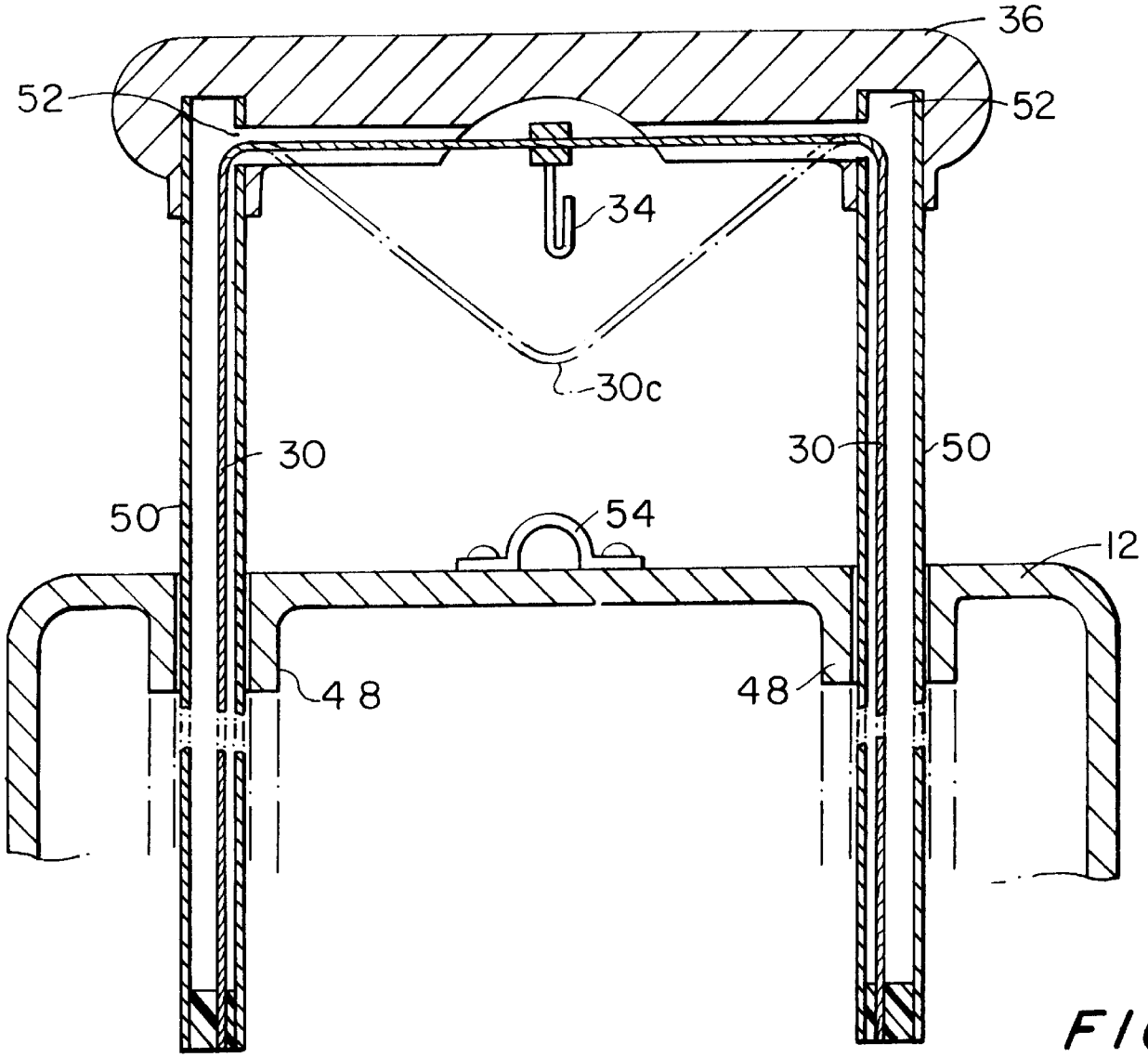

Referring now to FIG. 11, and as is well known, the body 12 of the main case provides guides 48 in which hollow poles 50 are guided for sliding movement longitudinally of the poles 50, the poles 50 being connected to the cross-bar 36.

Confined within the hollowed poles 50 is the extensible member 30, which is passed through apertures 52 at the upper ends of the hollow poles 50, the extensible member then, in the retracted position of the extensible member, lying within a groove formed on the underside of the cross-bar 36. Optionally, the extensible member can be provided with a hook 34, which, in the extended position of the extensible member while it encircles the auxiliary article of luggage (not shown) at the top wall of the case can be hooked into an eyelet 54.

By this arrangement, the extensible member is contained entirely within the handle and its support poles, and, is not required separately to be positioned within the main case 12, or, in guides attached externally to the rear face of the main case 12.

In FIG. 12, as suggested in FIG. 8, the extensible member 30 is connected at its opposite ends to coil springs 42, which also are contained within the hollow poles 50. Also, the hook 34 for holding the extensible member in an extended position may be deleted. Instead, a bracket member diagrammatically illustrated at 56 is secured to the exterior surface of the wheeled carry-on case, it merely being necessary to place the auxiliary article of luggage (not shown) on the top wall 21, encircle same with the member 30, and slip the central portion 30A of the member 30 under the tongue of the bracket member 56, which, conveniently can be positioned on the front wall 18 of the carry-on case. Clearly, any other form of axially extendible spring members can be employed in substitution for the coil springs 42.

Figure 13:
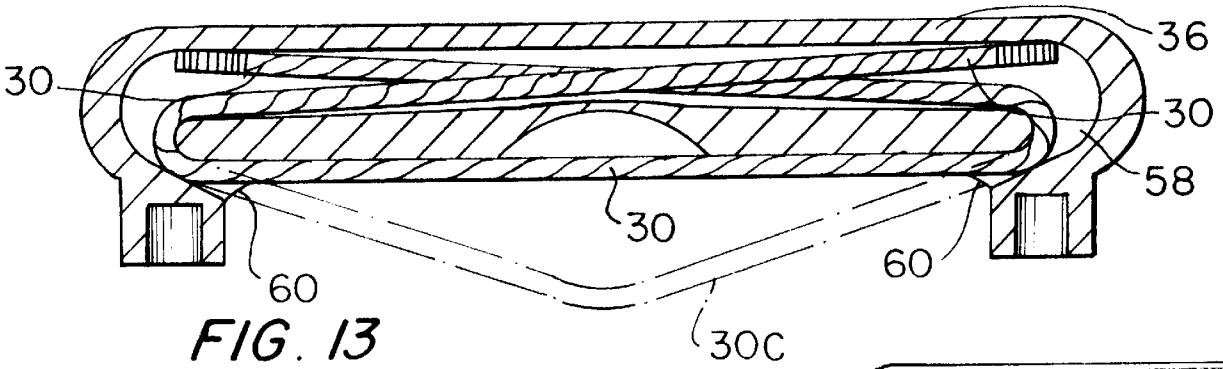

Referring now to FIG. 13, which is a modification of FIG. 12, the extensible member 30 is confined entirely within the cross-bar 36, the opposite ends of the extensible member extending in crossing relationship longitudinally of a channel 58 provided internally of the cross-bar 36, and then emerging through slots 60 at the opposite sides of the cross-bar 36, for the extensible member then to traverse the underside of the cross-bar 36, from which it can be downwardly withdrawn as indicated by the chain dotted lines 30*c* for it to be entrained around the article of auxiliary luggage and central portion and thereafter secured to a bracket member such as 56, shown in FIG. 13.

A particular advantage accruing from the embodiments of FIGS. 11–13, is that a handle for the wheeled carry-on case can be provided that incorporates the extensible member 30 of the present invention, and, which can be substituted for the conventional handle illustrated in prior art FIG. 1. When employing the cross-bar of FIG. 13, the poles 50 of FIGS. 11 and 12 are not required to be hollow, the cross-bar 36 of FIG. 13 being substitutable for a conventional cross-bar 36 as illustrated in prior art FIG. 1, again upgrading a conventional carry-on case for it to incorporate the teachings of the present invention.

Figure 14:
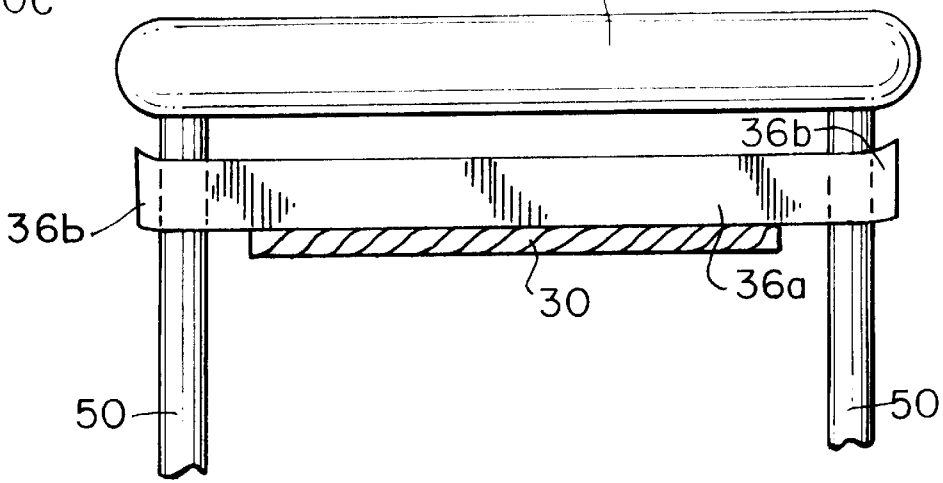
Figure 15:
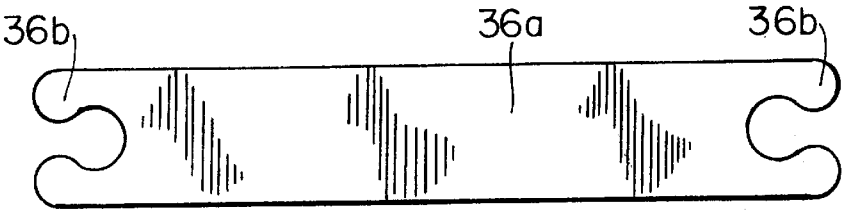

Alternatively,and as illustrated diagrammatically in FIG. 14, the extensible member 30 of FIG. 13 can be housed in an auxiliary cross-bar 36*a*, which can be snap-fitted between the side poles 50, and then slid longitudinally of the side poles 50 to bring the auxiliary cross-bar 36*a* into seated engagement with the existing cross-bar 36. The snap-fitting of the auxiliary cross-bar 36 onto the longitudinally extendible poles 50 easily can be arranged by forming the ends 36*b* of the auxiliary cross-bar 36*a* as bifurcated members that can snap-over and then frictionally grip the respective poles 50, as illustrated in FIG. 15.

FIGS. 16 and 17, shown as a further embodiment similar to FIG. 7, in which the extensible member 30 is located along the interior of the rear wall 19 of the wheeled case. The ends of the elongate extensible member 30 which pass through openings 70 in the case top wall are connected to a hook 34. Hook 34 will be attached to a looped connector 72, which is secured to the top wall 21 of the case by web 74, after the auxiliary article of luggage (not shown) is placed on the top wall of the case, and member 30 encircles same, to retain the auxiliary article of luggage against the surface of top wall 21. The internal routing of the elongate extensible member, is shown as an endless loop along the interior of the back wall, through a looped retaining element 76 centrally interior of the top wall and corner eyelets 40 at the bottom wall.

FIG. 18 generally corresponds to FIG. 16, both with the internal routing of the extensible member 30 modified. The ends are connected to upper retaining elements 76, and successively to lower retaining elements 40, and through top wall openings 70 for receiving hook 34.

Figure 19:
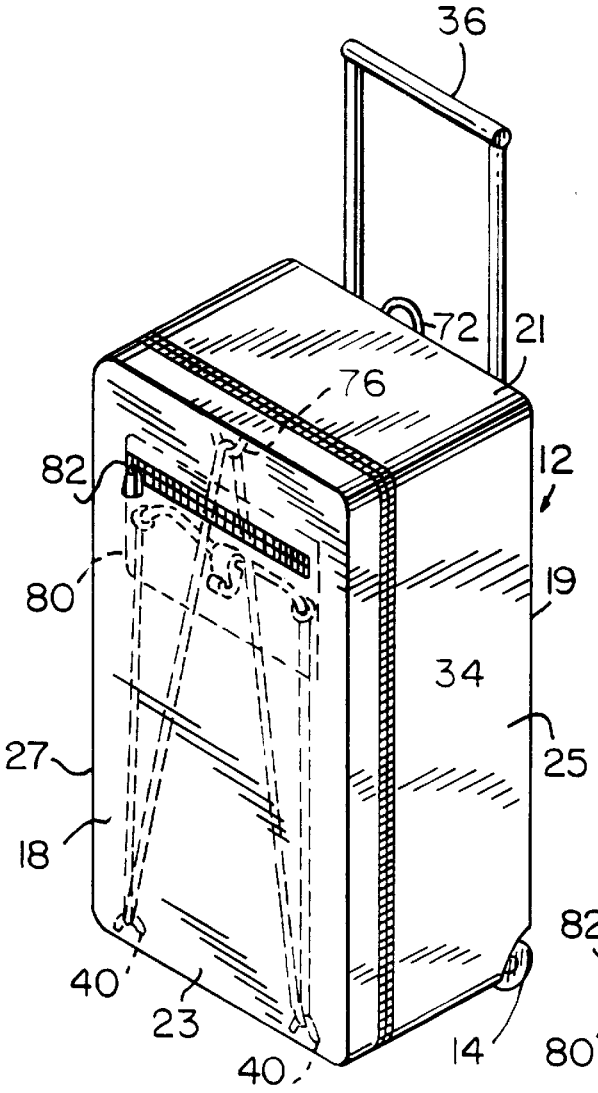
FIGS. 19 and 20 are perspective views of another embodiment, in which the extensible member is routed similar to that of FIGS. 16 and 17, but is located along the internal side of the front wall and is accessible through an exterior pocket of the wheeled case.
Figure 20:
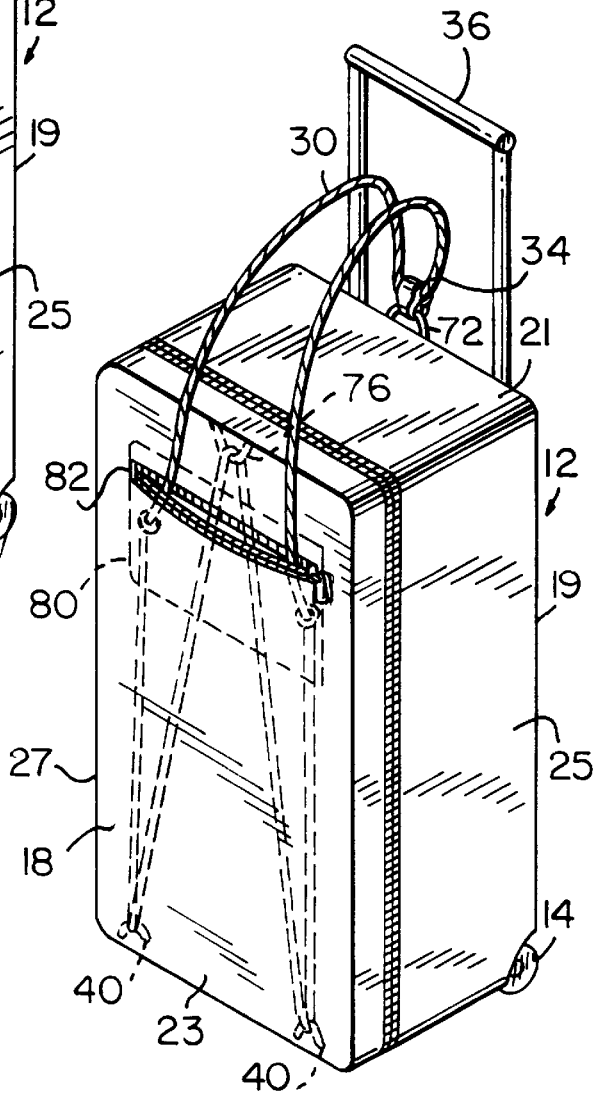

FIGS. 19 and 20, show in the perspective form another embodiment which has the internal routing of the extensible member 30 corresponding to that shown in FIGS. 7 and 16, but in which the extensible member is accessible via external pocket 80 and extends along the internal surface of the front wall 18 of the wheeled-case 12. In FIG. 19 the extensible member is in the non-activated position. The hook 34 is shown connected to the extensible member. In the non-activated condition the hook 34 will preferably be retained within a front pocket-like compartment 80, which is accessible by opening a closure member 82, which may typically be a zipper. When it is desired to utilize the extensible member for securing an auxiliary article at the top wall of the case 12, the compartment 80 is opened and hook 34 manually removed therefrom. The extensible member 30 will then be moved outward of the pocket 80 to encircle the auxiliary article (not shown) placed on the top wall 21 of the wheeled-case 12, with the hook 34 then being engaged within loop connector 72 located centrally of the upper edge of the rear wall 19 of the wheel-case 12.

Various other configurations will be apparent to persons skilled in the art that will provide an identical or equivalent function of storing the extensible member 30 in a retracted condition, and, permitting extension of the extensible member, to permit it to be wrapped around the auxiliary article of luggage 24, which is placed on the top wall of the case, and then be secured to a convenient securement, such as the cross-bar 36 of the handle 16 or separate connecting means providing on the case.

I claim:

1. In combination with a wheeled article of luggage including:

a case having top, front, back, side and bottom walls to define an openable article receiving enclosure;

wheels positioned along said bottom wall;

a manually graspable handle extending upwardly with respect to said top wall to guide rolling movement of the article of luggage with rotation of said wheels along a surface;

an elongate securement strap member secured to the interior of said case for selective movement between a stored retracted position completely within said case and an operable extended position exterior of said case;

said elongate securement strap member operably located on said case to securely encircle an auxiliary article positioned on said top wall when said elongate securement strap member is in its operable extended position;

one of said front or back walls including an external pocket;

said elongate securement strap member extending into, and externally accessible via, said external pocket;

said elongate securement strap member manually movable between said stored retracted position contained within said external pocket, and said operable extended position projecting outward of said external pocket;

securing means carried by said elongate securement strap member for releasably securing said elongate securement strap member to a connection member on the other of said front or back walls when said elongate securement strap member is in its operable extended position and encircling an auxiliary article at said top wall; whereby said elongate securement strap member selectively retains an auxiliary article on the surface of said top wall.

2. The combination of claim 1, wherein said elongate securement strap member is an extensible member.

3. The combination of claim 2, wherein said elongate extensible member includes biasing means opposing the maintenance of its extended operable position and urging it towards its stored retracted position, whereby an extent of said extensible member urges the auxiliary article of luggage to maintain contact against said top wall when said extensible member is secured to said connection member.

4. The combination of claim 3, wherein said biasing means includes elastic within said elongate extensible member.

5. The combination of claim 4, further including closure means for selective opening and closure of said external pocket.

6. The combination of claim 5, wherein said closure means is a zipper.

7. The combination of claim 1 wherein that external pocket is at said front wall and said connection member is at said back wall.

8. The combination of claim 1 wherein said external pocket is at an intermediate region of said front wall and said connection member is at the juncture of said top and back walls.

9. In combination with a wheeled article of luggage including:

a case having first opposed front and back walls, second opposed side walls, and third opposed top and bottom walls to define an openable article receiving enclosure;

wheels positioned along said bottom wall;

said case adapted to be placed on a surface with said wheels contacting the surface;

a manually graspable handle extending upwardly with respect to said top wall to guide rolling movement of the article of luggage with rotation of said wheels along a surface;

an elongate extensible member secured to the interior of said case for selective movement between a stored retracted position completely within said case and an operable extended position exterior of said case;

said elongate extensible member operably located on said case to securely encircle an auxiliary article positioned on said top wall, when said elongate extensible member is in its operable extended position;

securing means carried by said elongate extensible member for releasably securing said elongate extensible member to a connection member when said elongate extensible member is in its operable extended position and encircling an auxiliary article at said top wall; whereby said elongate extensible member selectively retains an auxiliary article on the surface of said top wall;

one of said first or second opposed walls including an external pocket, said elongate extensible member internally located within said external pocket, and externally accessible via, said external pocket;

said external pocket including a closure means for manual closing of said pocket with said elongate extensible member being stored within said pocket.

10. The combination of claim 9, wherein said closure means is a zipper.

11. The combination of claim 9, wherein said external pocket is within one of said first opposed walls.

12. In combination with a wheeled article of luggage including:

a case having first opposed front and back walls, second opposed side walls, and third opposed top and bottom walls to define and openable article receiving enclosure;

wheels positioned along said bottom wall;

said case adapted to be placed on a surface with said wheels contacting the surface;

a manually graspable handle extending upwardly with respect to said top wall to guide rolling movement of the article of luggage with rotation of said wheels along a surface;

an elongate extensible member secured to said case for selective movement between a stored retracted position and an operable extended position;

said elongate extensible member operably located on said case to securely encircle an auxiliary article positioned on said top wall when said elongate extensible member is in its operable extended position;

securing means carried by said elongate extensible member for releasably securing said elongate extensible member to a connection member when said elongate extensible member is in its operable extended position and encircling an auxiliary article at said top wall; whereby said elongate extensible member selectively retains an auxiliary article on the surface of said top wall;

one of said first or second opposed walls including an external pocket;

said elongate extensible member located within, and externally accessible via, said external pocket;

said external pocket including a closure means for manual closing of said pocket with said elongate extensible member being stored within said pocket;

said external pocket is within one of said first opposed walls, and further including:

three spaced retaining elements for routing said elongate extensible member through said case and into said pocket, said retaining elements being at opposed bottom corners and centered along said top wall; said elongate extensible member being successively routed from said top retaining element, to said bottom retaining elements, into said pocket from a continuous loop.

13. In combination with a wheeled article of luggage including:

a case having top, front, back, side and bottom walls to define an openable article receiving enclosure;

wheels positioned along said bottom wall;

a manually graspable handle extending upwardly with respect to said top wall to guide rolling movement of the article of luggage with rotation of said wheels along a surface;

an elongate securement strap member secured to said case for selective movement between a stored retracted position and an operable extended position;

said elongate securement strap member operably located on said case to securely encircle an auxiliary article positioned on said top wall when said elongate securement strap member is in its operable extended position;

one of said walls including an external pocket;

said elongate securement strap member extending into, and externally accessible via, said external pocket;

said elongate securement strap member manually movable between said stored retracted position contained within said external pocket, and said operable extended position projecting outward of said external pocket;

securing means carried by said elongate securement strap member for releasably securing said elongate securement strap member to a connection member when said elongate securement strap member is in its operable extended position and encircling an auxiliary article at said top wall; whereby said elongate securement strap member selectively retains an auxiliary article on the surface of said top wall, and further including guide members positioned within said case to permit multiple passes of said elongate securement strap.

* * * * *